US005865693A

United States Patent [19]

Johnson

[11] Patent Number: 5,865,693

[45] Date of Patent: Feb. 2, 1999

[54] INFLATABLE SOCCER GOAL

[76] Inventor: Dean A. Johnson, 6 N. 617 McKay Dr., St. Charles, Ill. 60175

[21] Appl. No.: 4,221

[22] Filed: Jan. 8, 1998

[51] Int. Cl.[6] ..... A63B 63/00

[52] U.S. Cl. ..... 473/478; 273/400; 472/134

[58] Field of Search ..... 473/476, 478; 472/134; 273/400

[56] References Cited

U.S. PATENT DOCUMENTS

| | | | |
|---|---|---|---|
| D. 356,841 | 3/1995 | Temple | D21/200 |
| 5,205,086 | 4/1993 | Heim | 52/2.13 |
| 5,372,368 | 12/1994 | Pavonetti | 473/478 |
| 5,413,340 | 5/1995 | Potvin et al. | 273/400 X |
| 5,413,356 | 5/1995 | Bigelow | 273/400 |
| 5,421,128 | 6/1995 | Sharpless et al. | 52/2.13 |
| 5,586,768 | 12/1996 | Pavonetti | 473/478 |

FOREIGN PATENT DOCUMENTS

| | | | |
|---|---|---|---|
| 2172509 | 9/1986 | United Kingdom | 273/400 |

*Primary Examiner*—William H. Grieb

[57] ABSTRACT

A new inflatable soccer goal for allowing for easy transportation and set up. The inventive device includes a contiguous peripheral frame comprised of inflatable tubing. A nylon net extends within the contiguous peripheral frame.

5 Claims, 2 Drawing Sheets

INFLATABLE SOCCER GOAL

BACKGROUND OF THE INVENTION

1. Field of the Invention

The present invention relates to adjustable goal frames and more particularly pertains to a new inflatable soccer goal for allowing for easy transportation and set up.

2. Description of the Prior Art

The use of adjustable goal frames is known in the prior art. More specifically, adjustable goal frames heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable goal frames include U.S. Pat. No. 5,413,356 to Bigelow; U.S. Pat. No. 5,413,340 to Potvin et al.; U.S. Pat. No. Des. 356,841 to Temple; U.S. Pat. No. 5,372,368 to Pavonetti; U.S. Pat. No. 5,421,128 to Sharpless et al.; and U.S. Pat. No. 5,205,086 to Heim.

While these devices fulfill their respective, particular objectives and requirements, the aforementioned patents do not disclose a new inflatable soccer goal. The inventive device includes a contiguous peripheral frame comprised of inflatable tubing. A nylon net extends within the contiguous peripheral frame.

In these respects, the inflatable soccer goal according to the present invention substantially departs from the conventional concepts and designs of the prior art, and in so doing provides an apparatus primarily developed for the purpose of allowing for easy transportation and set up.

SUMMARY OF THE INVENTION

In view of the foregoing disadvantages inherent in the known types of adjustable goal frames now present in the prior art, the present invention provides a new inflatable soccer goal construction wherein the same can be utilized for allowing for easy transportation and set up.

The general purpose of the present invention, which will be described subsequently in greater detail, is to provide a new inflatable soccer goal apparatus and method which has many of the advantages of the adjustable goal frames mentioned heretofore and many novel features that result in a new inflatable soccer goal which is not anticipated, rendered obvious, suggested, or even implied by any of the prior art adjustable goal frames, either alone or in any combination thereof.

To attain this, the present invention generally comprises a contiguous peripheral frame comprised of inflatable tubing. The peripheral frame includes a front section, a back section, a top section and opposed side sections. The peripheral frame includes at least one inflation tube in communication with an air inflatable interior thereof. The peripheral frame includes a pair of rear support bars extending from the top section to the back section. The rear support bars include outwardly extending tab portions. The tab portions have apertures therethrough. The opposed side sections each have a tab portion extending outwardly from a lower segment thereof. The tab portion has an aperture therethrough. A nylon net extend within the contiguous peripheral frame. A plurality of corkscrew fasteners extend through the apertures of the tab portions of the contiguous peripheral frame. The corkscrew fasteners penetrate a ground surface for securement of the contiguous peripheral frame thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable soccer goal apparatus and method which has many of the advantages of the adjustable goal frames mentioned heretofore and many novel features that result in a new inflatable soccer goal which is not anticipated, rendered obvious, suggested, or even implied by any of the prior art adjustable goal frames, either alone or in any combination thereof.

It is another object of the present invention to provide a new inflatable soccer goal which may be easily and efficiently manufactured and marketed.

It is a further object of the present invention to provide a new inflatable soccer goal which is of a durable and reliable construction.

An even further object of the present invention is to provide a new inflatable soccer goal which is susceptible of a low cost of manufacture with regard to both materials and labor, and which accordingly is then susceptible of low prices of sale to the consuming public, thereby making such inflatable soccer goal economically available to the buying public.

Still yet another object of the present invention is to provide a new inflatable soccer goal which provides in the apparatuses and methods of the prior art some of the advantages thereof, while simultaneously overcoming some of the disadvantages normally associated therewith.

Still another object of the present invention is to provide a new inflatable soccer goal for allowing for easy transportation and set up.

Yet another object of the present invention is to provide a new inflatable soccer goal which includes a contiguous peripheral frame comprised of inflatable tubing. A nylon net extends within the contiguous peripheral frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
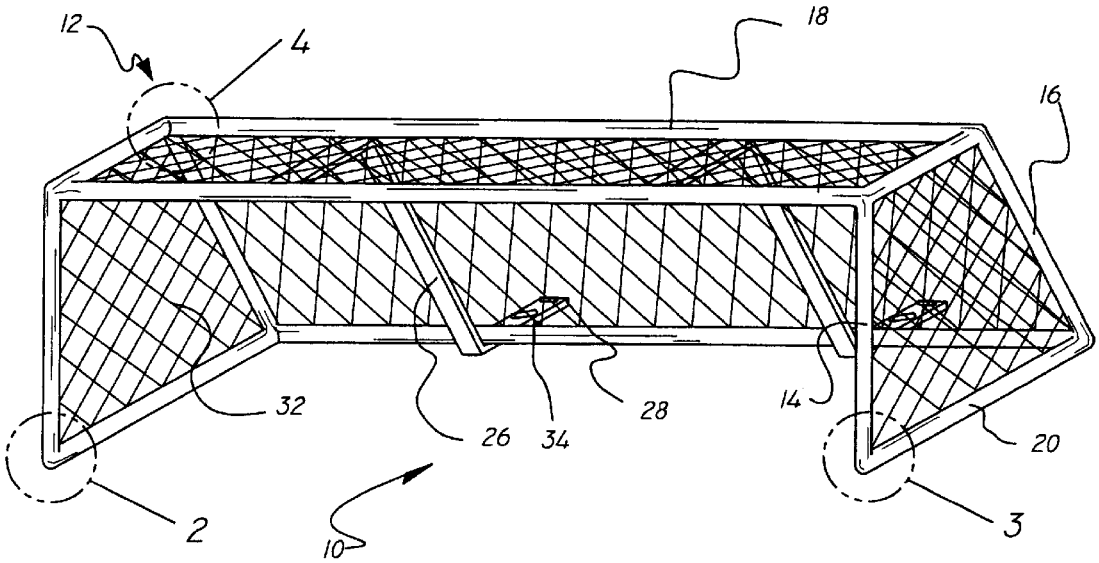
FIG. 1 is a front view of a new inflatable soccer goal according to the present invention.
Figure 2:
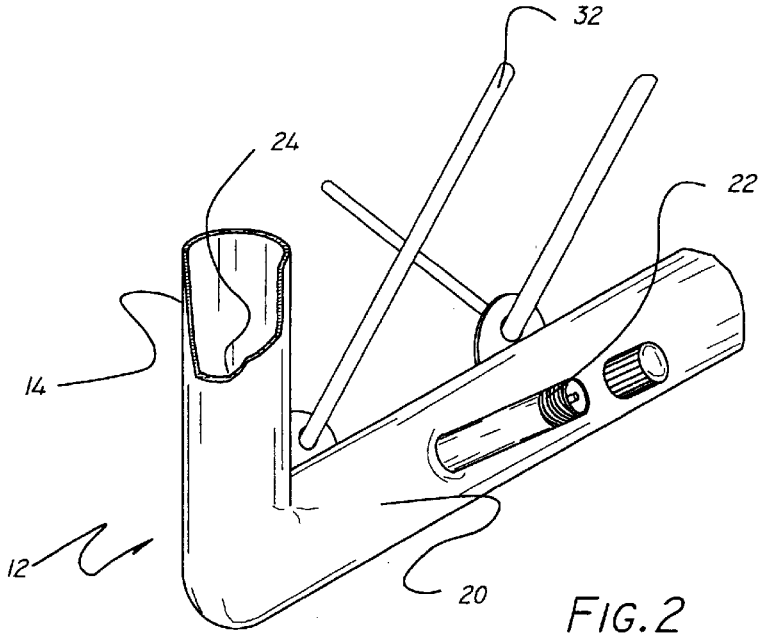
FIG. 2 is a partial view of the present invention as taken from circle 2 of FIG. 1.
Figure 3:
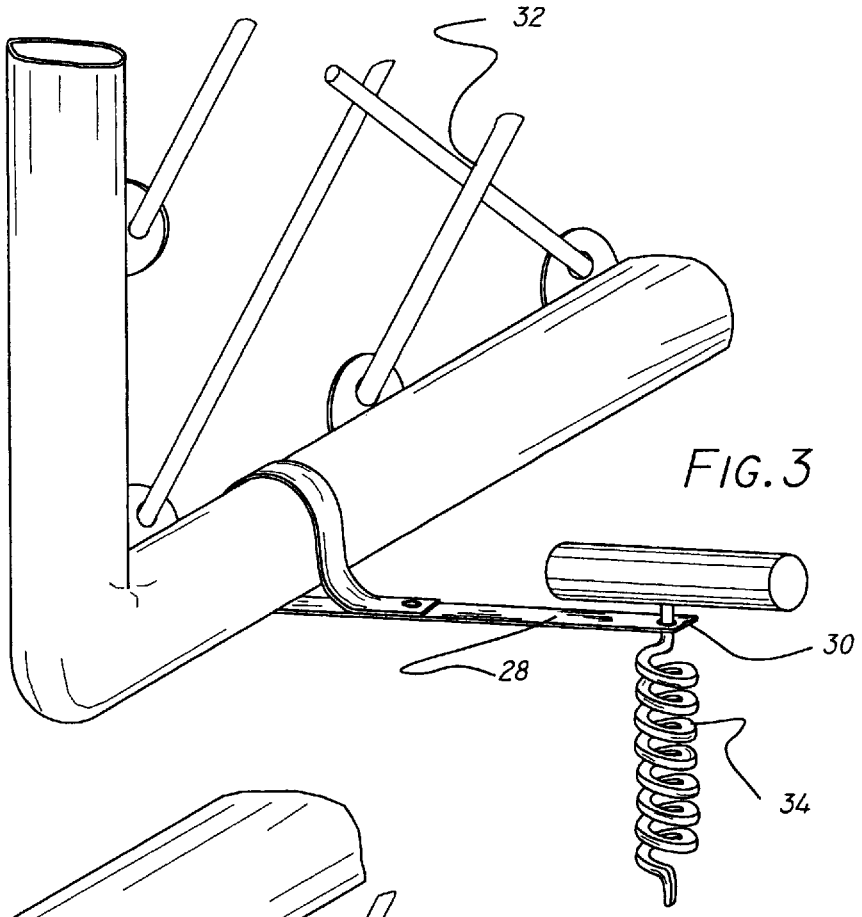
FIG. 3 is a partial view of the present invention as taken from circle 3 of FIG. 1.
Figure 4:
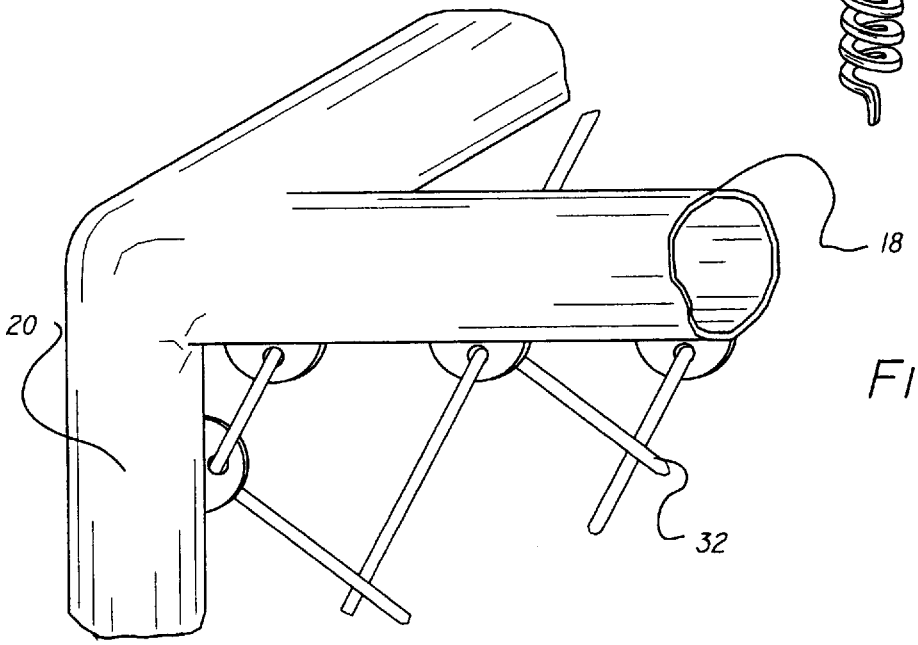
FIG. 4 is a partial view of the present invention as taken from circle 4 of FIG. 1.

With reference now to the drawings, and in particular to FIGS. 1 through 4 thereof, a new inflatable soccer goal embodying the principles and concepts of the present invention and generally designated by the reference numeral 10 will be described.

As best illustrated in FIGS. I through 4, the inflatable soccer goal 10 comprises a contiguous peripheral frame 12 comprised of inflatable tubing. The peripheral frame 12 includes a front section 14, a back section 16, a top section 18 and opposed side sections 20. The peripheral frame 12 includes at least one inflation tube 22 in communication with an air inflatable interior 24 thereof. The peripheral frame 12 includes a pair of rear support bars 26 extending from the top section 18 to the back section 16. The rear support bars 26 include outwardly extending tab portions 28. The tab portions 28 have apertures therethrough. The opposed side sections 20 each have a tab portion 28 extending outwardly from a lower segment thereof. The tab portion 28 has an aperture 30 therethrough.

A nylon net 32 extends within the contiguous peripheral frame 12.

A plurality of corkscrew fasteners 34 extend through the apertures 30 of the tab portions 28 of the contiguous peripheral frame 12. The corkscrew fasteners 34 penetrate a ground surface for securement of the contiguous peripheral frame 12 thereto.

In use, the present invention can be easily transported from place to place. The user simply positions the device 10 at a desired location and inflates it with a portable small compressor. After use, the device 10 can be simply deflated and stored away until the next use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new inflatable soccer goal for allowing for easy transportation and set up comprising, in combination:

a contiguous peripheral frame comprised of inflatable tubing, the peripheral frame including a front section, a top section, a back section extending downwardly and rearwardly from the top section, and opposed side sections, the peripheral frame including at least one inflation tube in communication with an air inflatable interior thereof, the peripheral frame including a pair of rear support bars extending from the top section to the back section for supporting the peripheral frame, the rear support bars each including a horizontally oriented upper extent with a length equal to a depth of the top section, an intermediate extent coupled to a rear end of the upper extent and extending downwardly and rearwardly along the back section within a vertical plane, and a horizontally oriented lower extent coupled to a bottom end of the intermediate extent and extending rearwardly therefrom beneath the peripheral frame in parallel relationship with the upper extent thereby defining an outwardly extending tab portion, the tab portions of the rear support bars each having vertically oriented apertures therethrough, the opposed side sections each having a tab portion with a circular inboard portion encompassing one of the side sections and a linear outboard portion extending outwardly from a lower segment thereof in coplanar relationship with a lower edge of the lower segment, the tab portion of each side section having a vertically oriented aperture therethrough;

a nylon net extending within the contiguous peripheral frame; and a plurality of corkscrew ground anchors each including a horizontally oriented handle and a lower portion having a vertically oriented top coupled to a central extent of the handle, a vertically oriented bottom defining a spike, and an intermediate extent coupled between the top and the bottom of the lower portion for defining a helix which has a hollow center in line with the top and bottom of the lower portion, the top of the lower portion of each corkscrew ground anchor extending through the aperture of one of the tab portions of the contiguous peripheral frame, the corkscrew ground anchors being adapted for penetrating a ground surface for securement of the contiguous peripheral frame thereto.

2. A new inflatable soccer goal for allowing for easy transportation and set up comprising, in combination:

a contiguous peripheral frame comprised of inflatable tubing, wherein the peripheral frame includes a front section, a top section, a back section extending downwardly and rearwardly from the top section, and opposed side sections, the peripheral frame further including rear support bars for supporting the peripheral frame, each rear support bar having a horizontally oriented upper extent, an intermediate extent coupled to a rear end of the upper extent and extending downwardly and rearwardly along the back section, and a horizontally oriented lower extent coupled to a bottom end of the intermediate extent and extending rearwardly therefrom and positioned in parallel relationship with the upper extent to define an outwardly extending tab portion, the tab portions of the rear support bars each having at least one vertically oriented aperture therethrough;

a nylon net extending within the contiguous peripheral frame; and a plurality of corkscrew ground anchors each including a horizontally oriented handle and a lower portion having a vertically oriented top coupled to a central extent of the handle, a vertically oriented bottom defining a spike, and an intermediate extent coupled between the top and the bottom for defining a helix which has a hollow center in line with the top and bottom of the lower portion, the top of the lower portion of each corkscrew ground anchor extending through the aperture of one of the tab portions of the contiguous peripheral frame, the corkscrew ground anchors being adapted for penetrating a around surface for securement of the contiguous peripheral frame thereto.

3. The inflatable soccer goal as set forth in claim 2 wherein the peripheral frame includes at least one inflation tube in communication with an air inflatable interior thereof.

4. The inflatable soccer goal as set forth in claim 2 wherein the opposed side sections each have a tab portion extending outwardly from a lower segment thereof in coplanar relationship with a lower edge of the lower segment, the tab portion having a vertically oriented aperture therethrough.

5. The inflatable soccer goal as set forth in claim 4 and further including a plurality of corkscrew ground anchors extending through the apertures of the tab portions of the side sections of the contiguous peripheral frame.

* * * * *